US005953965A

United States Patent [19]

Kaneyama et al.

[11] Patent Number: 5,953,965

[45] Date of Patent: Sep. 21, 1999

[54] DEVICE FOR TIGHTENING BOLT AND NUT

[75] Inventors: Yasunobu Kaneyama, Osaka; Shozo Matsumura; Kenji Sato, both of Toyonaka, all of Japan

[73] Assignee: Maeda Metal Industries, Ltd., Japan

[21] Appl. No.: 08/978,039

[22] Filed: Nov. 25, 1997

[51] Int. Cl.[6] ..... B25B 21/00

[52] U.S. Cl. ..... 81/55; 81/57; 81/469

[58] Field of Search ..... 81/55, 57, 56, 81/57.11, 469, 57.13

[56] References Cited

U.S. PATENT DOCUMENTS

| | | | |
|---|---|---|---|
| 3,323,394 | 6/1967 | Bangerter | 81/52.3 |
| 4,179,955 | 12/1979 | Akiyoshi et al. | 81/57.13 |
| 4,898,249 | 2/1990 | Ohmori | 81/469 |
| 4,966,057 | 10/1990 | Koppatsch | 81/469 |
| 5,404,775 | 4/1995 | Abe | 81/469 |
| 5,490,439 | 2/1996 | Matsumura et al. | 81/469 |
| 5,513,546 | 5/1996 | Ikeda et al. | 81/57.13 |
| 5,816,121 | 10/1998 | Yoshimizu et al. | 81/469 |

*Primary Examiner*—David A. Scherbel
*Assistant Examiner*—Sinclair Skinner
*Attorney, Agent, or Firm*—Bracewell & Patterson, L.L.P.

[57] ABSTRACT

A device for tightening a bolt and a nut including a housing having a planetary gear reduction mechanism accommodated therein, a rotational drive source attached to the housing for inputting power to the reduction mechanism, an inner socket coupled to one of two output shafts of the reduction mechanism and engageable with a tip at an end of the bolt, an outer socket coupled to the other output shaft of the reduction mechanism and engageable with the nut, and a torque sensor for detecting a predetermined tightening torque of the outer socket. An actuated brake is disengageably coupled to a rotation transmitting system for the inner socket, whereby fasteners of the one side type can be tightened up efficiently with safety.

4 Claims, 5 Drawing Sheets

DEVICE FOR TIGHTENING BOLT AND NUT

FIELD OF THE INVENTION

The present invention relates to a device for tightening bolts and nuts, and more particularly to a bolt-nut tightening device which is conveniently usable for fasteners of the one side type comprising a bolt and a nut which can be inserted and tightened up, respectively, at one side of the members to be fastened together.

BACKGROUND OF THE INVENTION

FIG. 7A shows a fastener 7 of the one side type which comprises a bolt 71 having at one end a tip 73 to be sheared, a tube 72 fitting around the bolt 71, and a washer 75 and a nut 74 which are mounted the bolt 71.

Members 9 are fastened together by inserting the fastener 7 through a bolt hole 91 in the members 9 from one side thereof (see FIG. 7B), tightening the nut 74 at the same side to plastically deform the tube end at the other side into a flange 70 (see FIG. 7C) and further tightening up the nut 74 with the members 9 held between the flange 70 and the nut 74 (see FIG. 7D).

Next, the reaction of rotation of the nut 74 is caused to act on the tip 73 at the bolt end to shear the tip (see FIG. 7E).

The series of tightening steps described can be performed by a conventional shear bolt tightening device.

The tightening device comprises a planetary gear reduction mechanism having two output shafts coupled to a motor and rotatable in directions opposite to each other. One of the outputs shafts is connected to an inner socket, and the other output shaft to an outer socket.

The fastener 7 is tightened with the nut 74 engaged in the outer socket and with the tip 73 engaged in the inner socket.

The bolt hole 91 in the members 9 is so sized that the fastener is fittable therein with a small clearance formed in the hole. Accordingly, the bolt 1 is freely rotatable if a torque acts thereon until the nut 74 is tightened to such an extent that the end of the tube 72 is deformed into the flange 70 as shown in FIG. 7C or 7D to immovably fix the bolt 71 to the members 9. When the bolt is in this state as tightened by the conventional shear bolt tightening device, the planetary gear reduction mechanism will rotate in its entirety with the same speed of rotation as the input shaft of the mechanism, failing to tighten up the nut and presenting a hazard.

This problem can be obviated by incorporating into the device means for preventing the rotation of the inner socket. When the tip 73 is to be sheared in this case by causing the reaction of tightening the nut 74 to act on the tip 73 in fully tightening up the nut as shown in FIGS. 7D and 7E, the reaction will act on the housing, turning the entire device in a direction opposite to the nut tightening direction to pose a serious hazard.

Accordingly, a tightening device has been proposed wherein a restraint mechanism provided between the housing and a planetary gear support frame connected to the inner socket is disengageable by a predetermined torque, such that the entire device is prevented from turning in the opposite direction to the nut tightening direction when the nut is to be tightened up completely (Pre-examination Japanese Utility Model Publication SHO 62-95879). This mechanism comprises an engaging ball rollably inserted in a through hole in the housing and biased by a spring so as to partially project from the inner surface of the housing and usually engage in a cavity in an end face of the inner gear of the planetary gear mechanism, the ball being releasable from the cavity when the inner gear is subjected to a torque not lower than a predetermined value.

The single ball is in pressing contact with the end face of the inner gear, and therefore low in engaging force and reliability. Further since the ball is engaged in the cavity in the end face of the inner gear to hold the inner gear, the holding position is limited to the position where the cavity is opposed to the ball. Consequently, if the inner gear rotates on slipping, the nut will be subsequently tightened with the inner gear left disengaged from the ball, rendering the restraint mechanism unable to function as contemplated.

Further because the inner gear end face is formed with the cavity for the ball to engage in to hold the inner gear, the cavity portion will wear away if the inner gear repeatedly slips to rotate, failing to maintain a constant torque.

An object of the invention is to provide a bolt-nut tightening device free of the foregoing problems.

SUMMARY OF THE INVENTION

The present invention provides a device for tightening a bolt and a nut which device comprises a housing having a planetary gear reduction mechanism accommodated therein and a handle projecting therefrom, an electric motor like rotational drive source attached to the housing for inputting power to the reduction mechanism, an inner socket coupled to one of two output shafts of the reduction mechanism and engageable with a tip at an end of the bolt, an outer socket coupled to the other output shaft of the reduction mechanism and engageable with the nut, and a torque sensor for detecting a predetermined tightening torque of the outer socket. An actuated brake is disengageably coupled to an inner gear included in the reduction mechanism and rotatable with the inner socket. The actuated brake comprises a friction member having a circular-arc pressing face in conformity with an outer peripheral surface of the inner gear in curvature and adapted for pressing contact with the outer peripheral surface of the inner gear, and an actuator assembly for pressing the friction member against the inner gear.

DETAILED DESCRIPTION OF THE INVENTION

Figure 1:
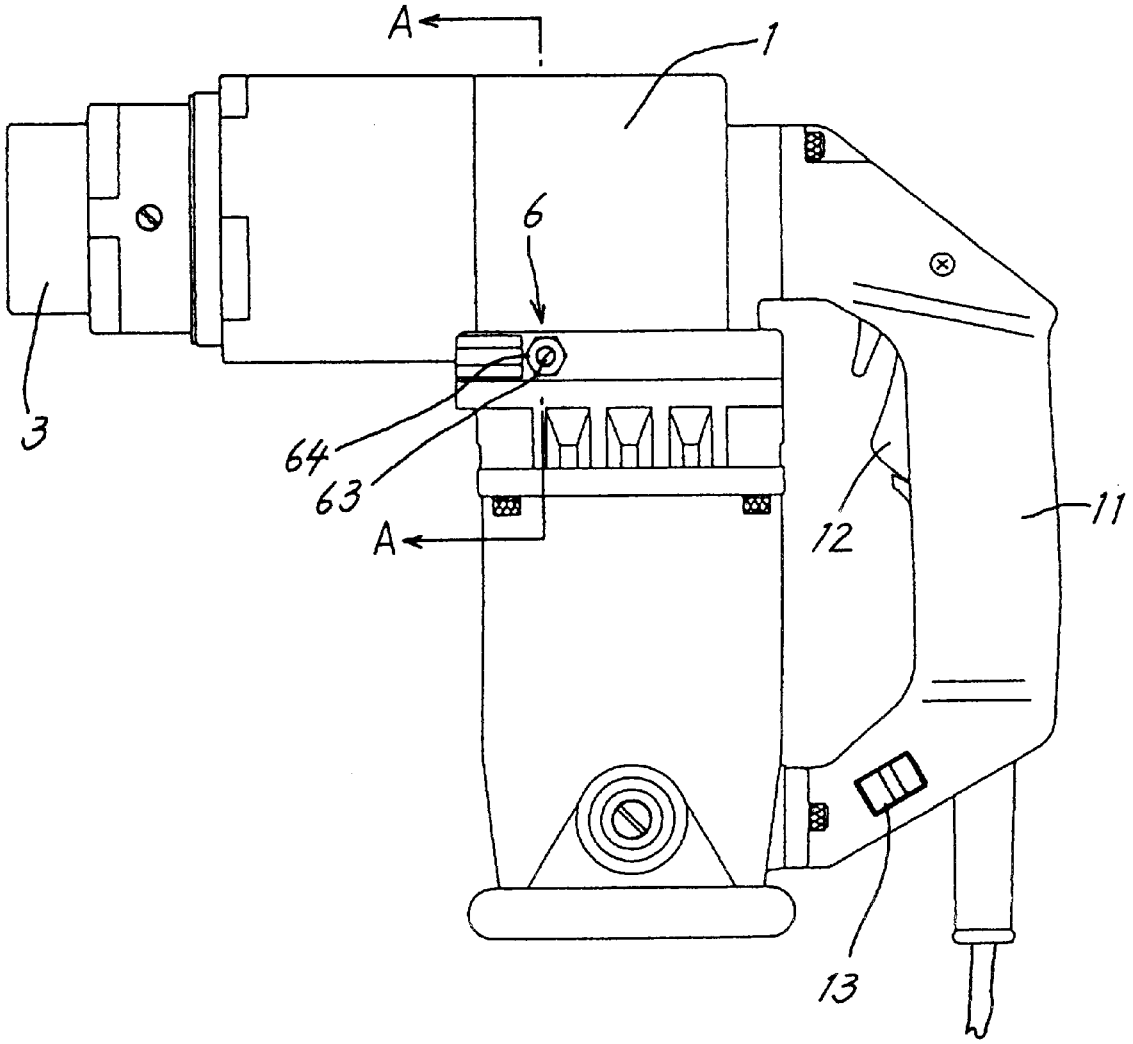
FIG. 1 is a front view of a bolt-nut tightening device.
Figure 2:
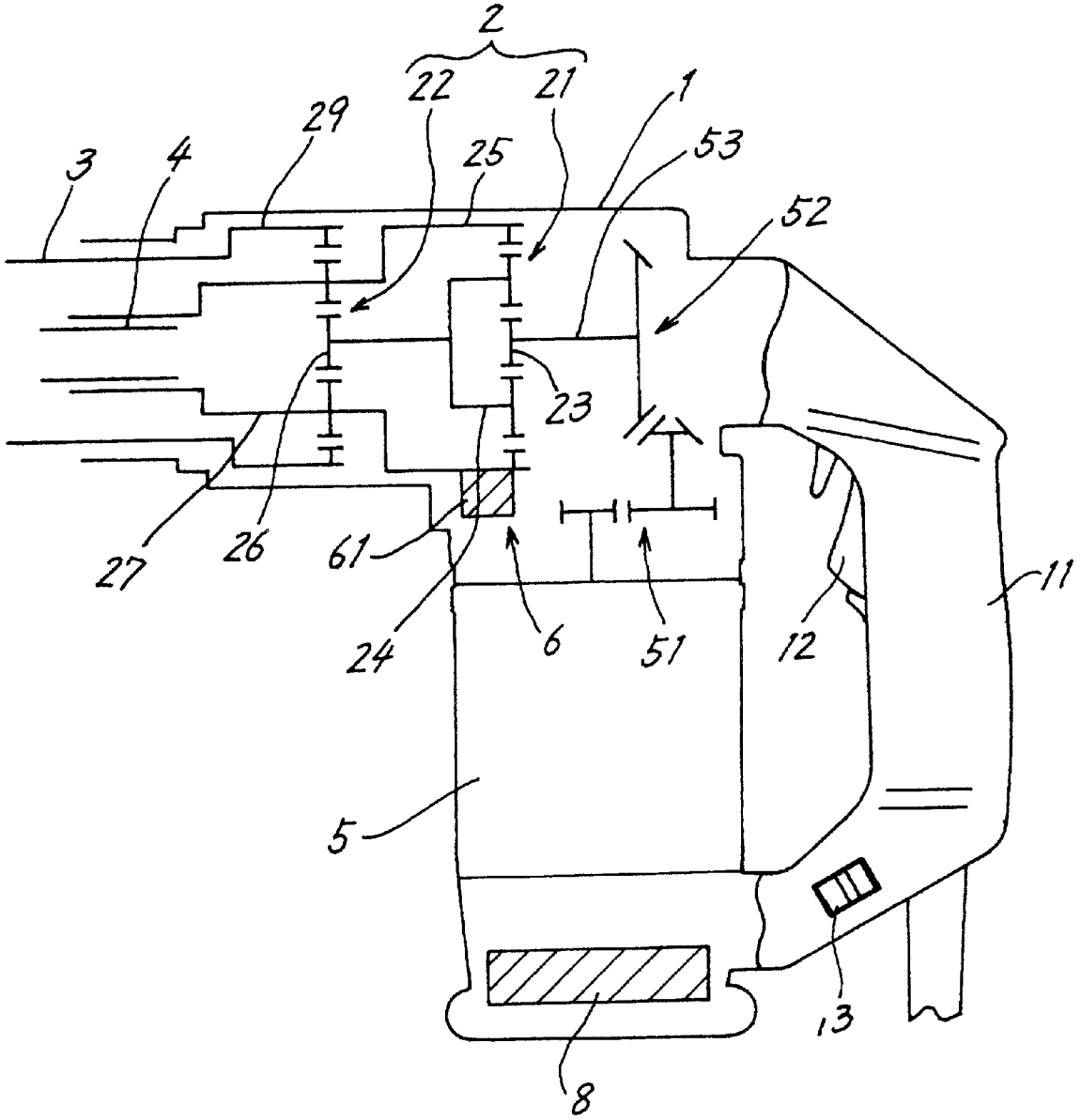
FIG. 2 is a diagram illustrating a rotation transmitting system included in the device.

The bolt-nut tightening device includes a tubular housing 1, a handle 11 projecting from the base end of the housing 1, and a rotational drive source, such as an electric motor 5 or air motor, provided approximately parallel to the handle.

The handle 11 is provided with a trigger switch 12 for turning on and off the drive source and a switch 13 for a change over from full tightening to pretightening and vice versa.

The housing 1 has an outer socket 3 projecting from its forward end.

A planetary gear reduction mechanism 2 is provided inside the housing 1.

The motor 5 is coupled to the reduction mechanism 2 via a spur gear 51 and bevel gear 52.

The reduction mechanism 2 has a known two-stage construction comprising a first planetary gear reduction unit 21 and a second planetary gear reduction unit 22 coupled to the unit 21.

The first reduction unit 21 comprises a sun gear 23 having an input shaft 53 connected thereto, and a planetary gear support frame 24 provided with a sun gear 26 of the second reduction unit 22.

The first reduction unit 21 has an inner gear 25 integral with a planetary gear support frame 27 of the second reduction unit 22. The unit 22 includes an inner gear 29 which has a forward end providing the outer socket 3.

The support frame 27 of the second reduction unit 22 is provided with an inner socket 4 rotatable with the frame 27 and slidable axially thereof. The inner socket 4 is biased outward by a spring (not shown).

The tightening device has a torque sensor 8 for detecting a tightening torque reaching a predetermined value.

The torque sensor 8 of the present embodiment is adapted to deenergize the motor 5 upon the current through the motor 5 reaching a predetermined value. After the switch 13 is operated for pretightening, the motor 5 is deenergized upon the current therethrough reaching such a value that the nut 74 of the fastener 7 is so pretightened as to clamp the members 9 between the nut and the flange 70 formed by the end of the tube 72, with the bolt 71 fixed to the members 9 against rotation as seen in FIG. 7D.

With the switch 13 changed over for full tightening, the motor 5 remains energized until the current reaches a value corresponding to a torque sufficient to shear the tip 73.

The torque sensor 8 can be of the electric type or mechanical type.

The present invention is characterized by an actuated brake 6 engageable with and disengageable from the rotational drive system of the inner socket 4.

Figure 3:
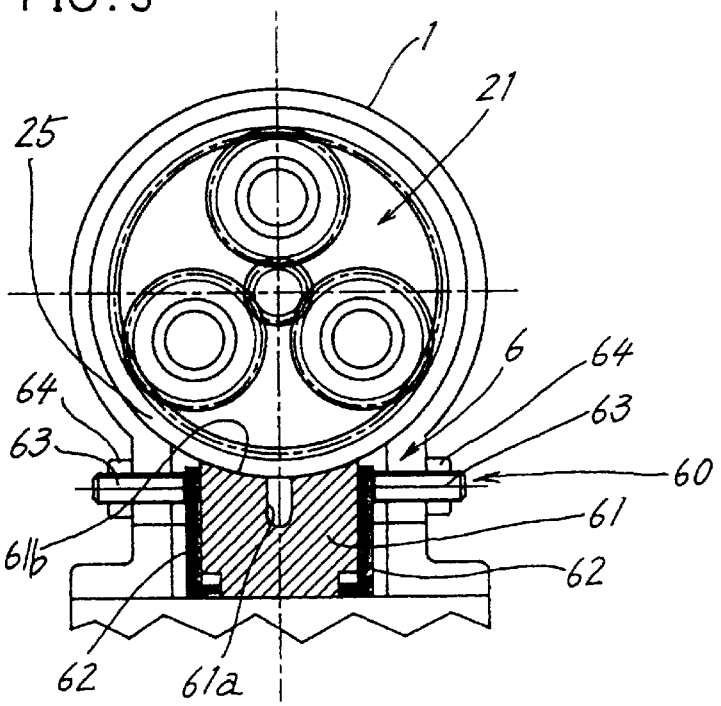
FIG. 3 is a view in section taken along the line A—A in FIG. 1.

With reference to FIGS. 1 and 3, the actuated brake 6 of the present embodiment comprises a friction member 61 disposed externally of and close to the inner gear 25 of the first reduction unit 21 (which gear is integral with the support frame 27 of the second reduction unit 22), and an actuator assembly 60 adjacent to the friction member 61.

The friction member 61 is made of an elastic material having a high coefficient of friction and formed with a circular-arc pressing face 61*b* opposed to the inner gear 25 and in conformity with the outer peripheral surface of the gear in curvature. A cutout 61*a* is formed in the center of the friction member 61 to facilitate deformation of the member 61.

The friction member 61 is provided on opposite side faces thereof with contact plates 62, 62. Two pressing bolts 63, 63 serving as the pressing means 60 for the friction member 61 extend through opposite side walls of the housing 1 in screw-thread engagement therewith and bear on the respective contact plates 62, 62.

A clamp nut 64 is screwed on each pressing bolt 63.

When tightened, the pressing bolts 63 elastically deform the friction member 61, pressing the member 61 against the inner gear 25 of the first planetary gear reduction unit 21 to brake the inner gear 25 and prevent the rotation of the inner socket 4.

When the pressing bolts 63 are loosened, the friction member 61 restores itself to the original form, disengaging the brake from the inner gear 25 and freeing the inner socket 4.

The bolt-nut tightening device of the invention is used in the manner to be described below.

Figure 7A:
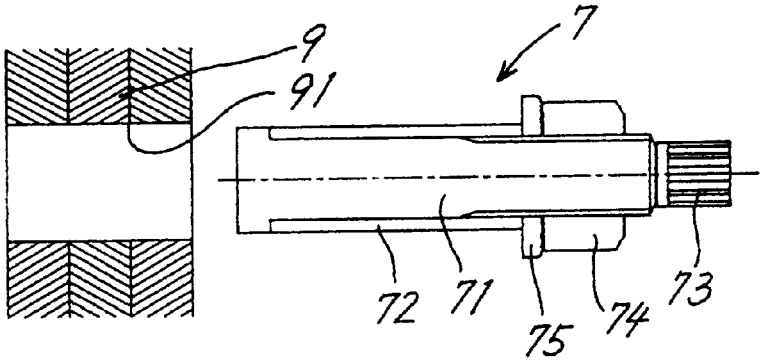
FIGS. 7A to 7E are diagrams illustrating a procedure for tightening a fastener of the one side type.
Figure 7B:
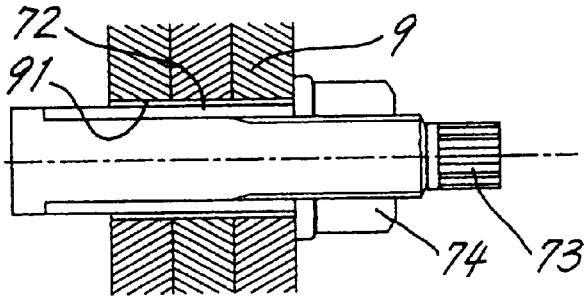

The fastener 7 is inserted through the bolt hole 91 in the members 9 to be fastened together, with the washer 75 bearing against the members 9 (FIG. 7B).

The outer socket 3 is fitted around the nut 74 to be tightened, with the tip 73 engaged in the inner socket 4.

The rotation transmitting system of the inner socket 4 is held braked, and the inner socket 4 is held out of rotation.

The switch 13 is turned on for pretightening, and the trigger switch 12 is actuated to start the electric motor 5. The torque of the motor 5 is transmitted to the sun gear 23 of the first planetary gear reduction unit 21 by way of the spur gear 51 and the bevel gear 52, bringing the planetary gear reduction mechanism 2 into operation.

With the brake applied to one of the two output shafts of the second reduction unit 22 at the second stage which is coupled to the inner socket 4, i. e., to the planetary gear support frame 27, the frame 27 is prevented from rotating, and only the other output shaft coupled to the outer socket 3, i.e., only the inner gear 29, rotates to tighten the nut 74 by the outer socket 3.

Tightening the nut 74 starts to plastically deform the opposite end of the tube 72 remote from the nut into a flange 70 (FIG. 7C) to clamp the members 9 between the flange 70 and the nut 74 and fix the bolt 71 to the members 9 against rotation (FIG. 7D).

Figure 7C:
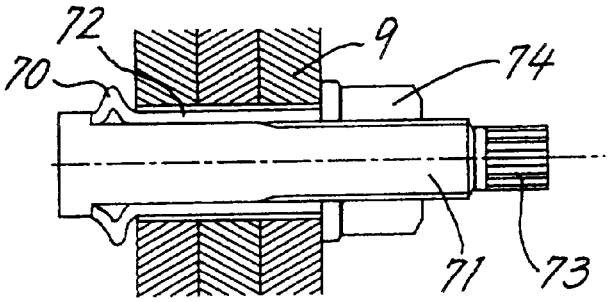
Figure 7D:
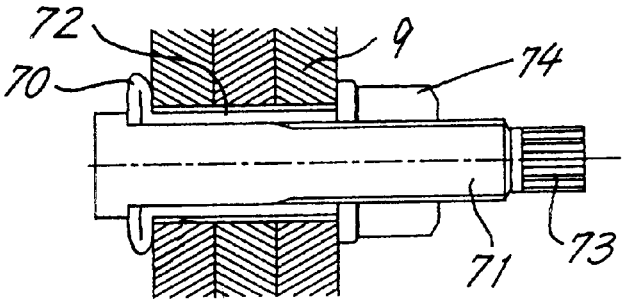
Figure 7E:
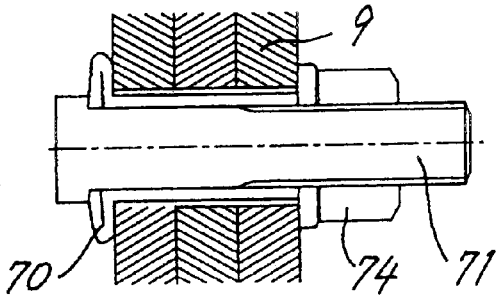

Between FIG. 7C and FIG. 7D, the tightening torque on the nut reaches the predetermined value, whereupon the torque sensor 8 detects this to deenergize the motor 5.

The outer socket 3 in rotation comes to a halt.

The pressing bolts 63 of the actuated brake 6 are loosened to disengage the brake from the inner gear 25 of the first reduction unit 21, i.e., from the inner socket 4.

The switch 13 is closed for full tightening, and the trigger switch 12 is turned on again to resume tightening.

In the above state, the nut 74 can be tightened up until the tip 73 is sheared, with the reaction of tightening of the nut 74 acting on the tip 73 through the inner socket.

The force acting on the inner socket 4 is in no way exerted on the housing of the tightening device, permitting the device to fully tighten up the nut with safety without the likelihood of the device turning in a direction opposite to the nut tightening direction.

With the bolt-nut tightening device of the invention described above, the inner socket 4 is restrained from rotating until the nut 74 is tightened to a state wherein the bolt 71 is fixed against rotation, preventing the planetary gear mechanism from rotating at a high speed therewith.

Further in shearing the tip 73, the inner socket 4 is released from the brake, preventing the tightening device from being turned by the tightening reaction, lessening the burden on the worker supporting the device and protecting the worker from the possible hazard.

The nut can be tightened by rotating the outer socket 3 only, with the actuated brake 6 reliably actuated by the actuator assembly 60. Further the inner socket 4 is readily released from the actuated brake 6, permitting the tightening reaction of the nut 74 to act on the tip 73 through the inner socket 4 and tightening up the nut until the tip 73 is sheared.

Since the friction member 61 is pressed against the outer peripheral surface of the inner gear at a portion thereof which is indefinite circumferentially of the gear, the surface is free of local wear circumferentially thereof, ensuring stabilized application of the brake.

The tightening device of the invention is usable not only for tightening fasteners 7 of the one side type but also for pretightening and fully tightening nuts on conventional shear bolts.

Figure 4:
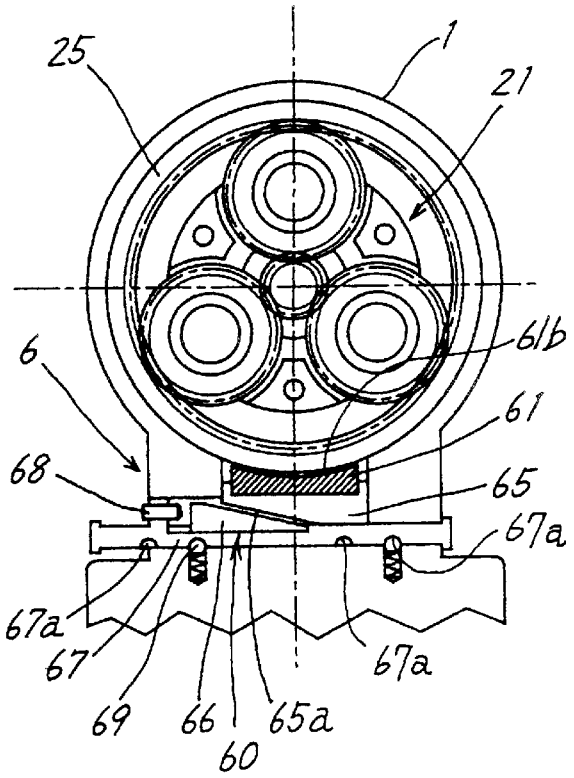
FIG. 4 is a sectional view showing another embodiment of a manually actuated brake.
Figure 5:
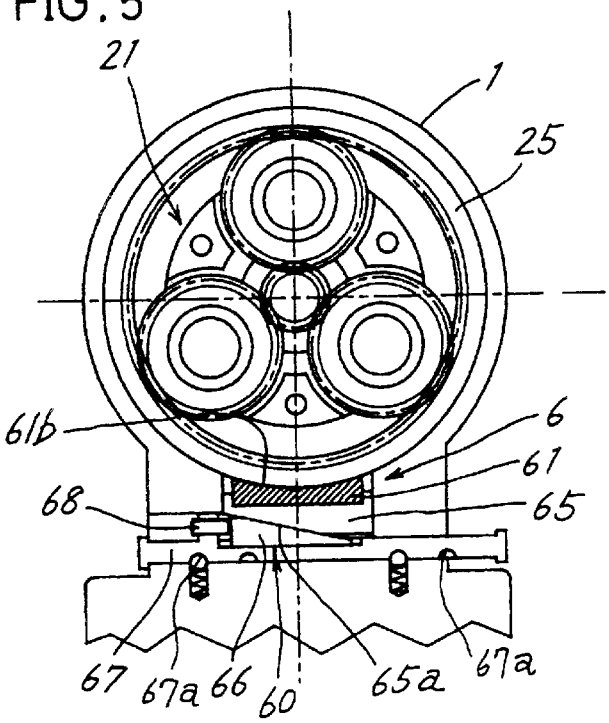
FIG. 5 is a sectional view showing the manually actuated brake means as actuated.

FIGS. 4 and 5 show another embodiment of a manually actuated brake 6.

A friction member 61 adapted for bearing contact with the inner gear 25 of the first reduction mechanism 21 is provided on a support 65, which has a tapered bottom face 65*a*.

Disposed under the support 65 is an actuator assembly 60 including a slide plate 67 extending through opposite side walls of the housing 1. A wedge 66 is mounted on the slide plate 67 and is movable a small distance in the sliding direction of the slide plate 67.

The slide plate 67 is provided with a contact adjusting screw 68 adapted to press the wedge 66, and is formed with a plurality of cavities 67*a* in its bottom face.

The housing 1 has balls 69 lightly engageable in the respective cavities 67*a* of the slide plate 67. The balls 69 are biased by springs to move into or retract from the path of sliding movement of the slide plate 67.

When the slide plate 67 is pushed in, the adjusting screw 68 presses the wedge 66 against the tapered face 65*a* of the support 65, lifting the support 65 and bringing the friction member 61 on the support 65 into pressing contact with the outer periphery of the inner gear 25 of the first reduction unit 21 to brake the rotation transmitting system of the inner socket 4 as shown in FIG. 5.

When the slide plate 67 is pushed from the other side opposite to the push-in side, the wedge 66 is moved out of pressing contact with the support tapered face 65*a* to disengage the brake. The actuated brake 6 of this embodiment is more convenient than the one shown in FIG. 3 since the brake can be applied by a snap-in action on the slide plate 67.

Figure 6:
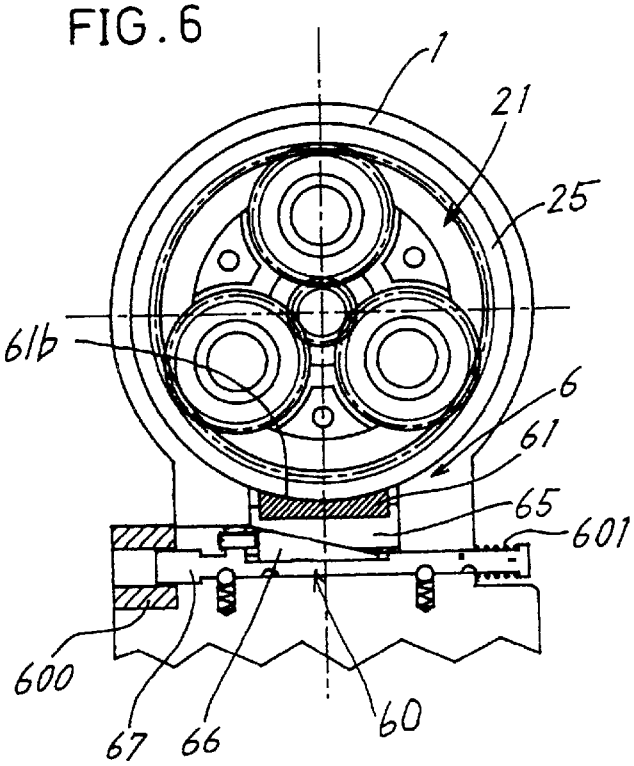
FIG. 6 is a sectional view of an automatically actuated brake.

FIG. 6 shows another embodiment, which is adapted to automatically release the rotation transmitting system of the inner socket 4 from a brake on completion of pretightening.

While this embodiment has basically the same construction as in FIG. 4, the housing 1 has a solenoid 600 provided for one end of the slide plate 67 for driving the slide plate 67, and a spring 601 is connected to the other end of the slide plate 67 for returning the plate.

The wedge 66 is usually in a pushed-in position in pressing contact with the support 65, holding the inner gear 25 of the first reduction unit 21 braked.

Upon the torque sensor 8 detecting the pretightening torque, the solenoid 600 is energized to move the slide plate 67 against the force of the spring 601, removing the wedge 66 from the support 65 and disengaging the brake from the inner gear 25 of the first reduction unit 21.

The pretightening-full tightening change-over switch 13 need not be provided when the brake means 6 of FIG. is used. There is no need to temporarily interrupt the operation of the tightening device on completion of pretightening if the torque sensor 8 is adapted to automatically energize the solenoid 600 upon detecting the predetermined value of tightening toque during the operation the device.

The device of the invention is not limited to the foregoing embodiments in construction but can be modified variously within the scope defined in the appended claims.

What is claimed is:

1. A nut tightening device for use in tightening a nut as screwed on a shear bolt having a tip to be sheared, the device comprising:

a housing having a planetary gear reduction mechanism accommodated therein and a handle projecting therefrom, said planetary gear reduction mechanism having a first output shaft and a second output shaft;

a rotational drive source attached to the housing for inputting power to the reduction mechanism;

an inner socket coupled to the first output shaft of the reduction mechanism and engageable with a tip to be sheared on a shear bolt;

an outer socket coupled to the second output shaft of the reduction mechanism and engageable with a nut as screwed on a shear bolt;

torque sensor for detecting a predetermined tightening torque of the outer socket; and an actuated brake including:

a friction member: and an actuator assembly connected to the friction member and being selectively operable to press the friction member against the first output shaft to prevent it from rotating.

2. The nut tightening device according to claim 1 wherein the actuator assembly comprises two pressing bolts screwed at a position on the housing and having ends opposed to the friction member, said pressing bolts on being tightened engaging the friction member and pressing it against the first output shaft.

3. The tightening device according to claim 1 wherein the actuator assembly comprises a slide plate slidably operable to wedge the friction member against the first output shaft.

4. The nut tightening device according to claim 1 wherein the actuator assembly comprises a slide plate slidably operable to wedge the friction member against the first output shaft, a solenoid coupled to said slide plate and operable to move the slide plate on commands from the torque sensor, and a return spring for opposing the force of the solenoid.

* * * * *